US005762403A

United States Patent [19]

Robinson

[11] Patent Number: 5,762,403

[45] Date of Patent: Jun. 9, 1998

[54] SLING TYPE FURNITURE PRODUCT

[75] Inventor: Steven D. Robinson, Rockingham, N.C.

[73] Assignee: Woodard, Inc., Owosso, Mich.

[21] Appl. No.: 748,275

[22] Filed: Nov. 13, 1996

[51] Int. Cl.[6] ..... A47C 7/00

[52] U.S. Cl. ..... 297/440.11; 297/452.13

[58] Field of Search ..... 297/440.11, 440.12, 297/452.12, 452.13, 452.2, 452.56

[56] References Cited

U.S. PATENT DOCUMENTS

| | | | |
|---|---|---|---|
| 3,024,068 | 3/1962 | Eames | 297/440.11 X |
| 3,167,352 | 1/1965 | Johnson | 297/452.13 X |
| 3,499,682 | 3/1970 | Orenstein | 297/440.11 X |
| 3,640,576 | 2/1972 | Morrison et al. | 297/440.11 |
| 4,579,383 | 4/1986 | Colby . | |
| 4,848,843 | 7/1989 | Gibbs | 297/440.11 X |
| 5,318,348 | 6/1994 | Hess | 297/440.11 |
| 5,360,258 | 11/1994 | Alivizatos | 297/440.11 |

OTHER PUBLICATIONS

Woodard Catalog 1994, Sea Island Pages.
Woodard Catalog 1994, Westchester Sling Pages.

*Primary Examiner*—Laurie K. Cranmer

*Attorney, Agent, or Firm*—Reising, Ethington, Learman & McCulloch, PLLC

[57] ABSTRACT

A furniture product with a leg supported frame has transversely spaced apart tubular side rails with slotted openings in wall faces thereof for receiving the sling edge loops of a web sling which spans the rails to support the weight of a furniture occupant. The side rails have rod-like members, of a cross-sectional configuration larger than the slotted openings, extending through the loops, to retain the loops within the rails. The sling loops include a synthetic plastic fabric core sheet provided with synthetic thermoplastic coats on each side, the core sheet edges forming the loops extending into the slotted openings and around the rod-like members, and then back out the slotted openings to positions terminating in heat welded seam folds of double core sheet thickness lying upon and braced by the rail wall faces. A decorative overcover for the core sheet has edges extending into the slotted openings and around the rod-like members, and then back out the slotted openings to a position underlying the seam folds.

17 Claims, 2 Drawing Sheets

SLING TYPE FURNITURE PRODUCT

The present invention relates to certain new and useful improvements in lightweight metal furniture products of the type which are employed on patios, around swimming pools, and other places where so-called casual furniture is utilized.

BACKGROUND OF THE INVENTION

The present invention is concerned with sling type furniture products and methods of manufacturing them and more particularly to fabric sling and rail assemblies which provide the seat and back surface on which the weight of the furniture occupant may be supported.

In U.S. Pat. No. 4,579,383 issued Apr. 1, 1986, a metal frame chair with so-called sling seat and back surfaces is disclosed and portrays what may be termed a "conventional sling and rail assembly structure". In this patent, a singular taut fabric strip having edge loops for entry into the associated side rails provided seat and back surfaces for the foldable chair which was specifically disclosed. The present invention is concerned with providing a sling type furniture product wherein the sling is constructed of multiple fabrics which provide a stronger and more durable furniture product exhibiting considerably greater tear strength. It is further of a construction which will permit a choice in the usually ornamental outer surfaces of the sling.

SUMMARY OF THE INVENTION

With the foregoing in mind, a furniture product has been invented which provides a sling with loop side edge sections formed of a thermoplastic material which, when assembled, extend into the metallic side rails around retaining rods and out of the side rails once again to a location in which the material can be heat welded to itself to form a very strong unitary seam consisting of double thicknesses of the material which seats on the side rails. An overcover fabric for this thermoplastic core material also extends into the side rail around the retaining rod and is secured in position beneath the core material seam by fixing it to a fabric undercover.

One of the prime objects of the present invention is to provide a unitary furniture product which utilizes a strong thermoplastic core sling which is thermally weldable, but which can be uniquely covered by a designer's choice of fabric which is pleasing to the eye to satisfy both structural strength and appearance requirements.

Another object of the invention is to provide a very economical method of manufacturing a sling type furniture product which has the aforementioned characteristics.

Still another object of the invention is to provide a sling type furniture product which can be constructed of lightweight aluminum components, and yet is structurally sound and can very safely support the weight of the furniture occupant.

Another object of the invention is to provide a sling type furniture product of reliable construction which avoids the creation of localized high stress areas and reacts to the weight of the furniture occupant in a manner to maintain the lateral stability of the furniture product when in use.

Still another object of the invention is to provide a sling type furniture product which is so manufactured that its sling remains taut and unwrinkled, and which does not expose cut sling material edges which would readily unravel.

Still another further object of the invention is to provide a relatively durably constructed sling type furniture product which permits a wide choice of covering fabric to provide a unit which is extremely attractive in appearance.

Other objects and advantages of the invention will become apparent with reference to the accompanying drawings and the accompanying descriptive matter.

THE DRAWINGS

The presently preferred embodiment of the invention is disclosed in the following description, and in the accompanying drawings, wherein:

FIG. 1 is a schematic perspective front elevational view illustrating a chair which incorporates the novel construction, the broken lines schematically illustrating parts of typical legs for supporting the chair;

FIG. 2, taken on the line 2—2 of FIG. 1, is a greatly enlarged fragmentary, schematic sectional elevational view illustrating the manner of formation of the sling and the manner in which it interacts with the metal sling rail;

DESCRIPTION OF PREFERRED EMBODIMENT

Figure 5:
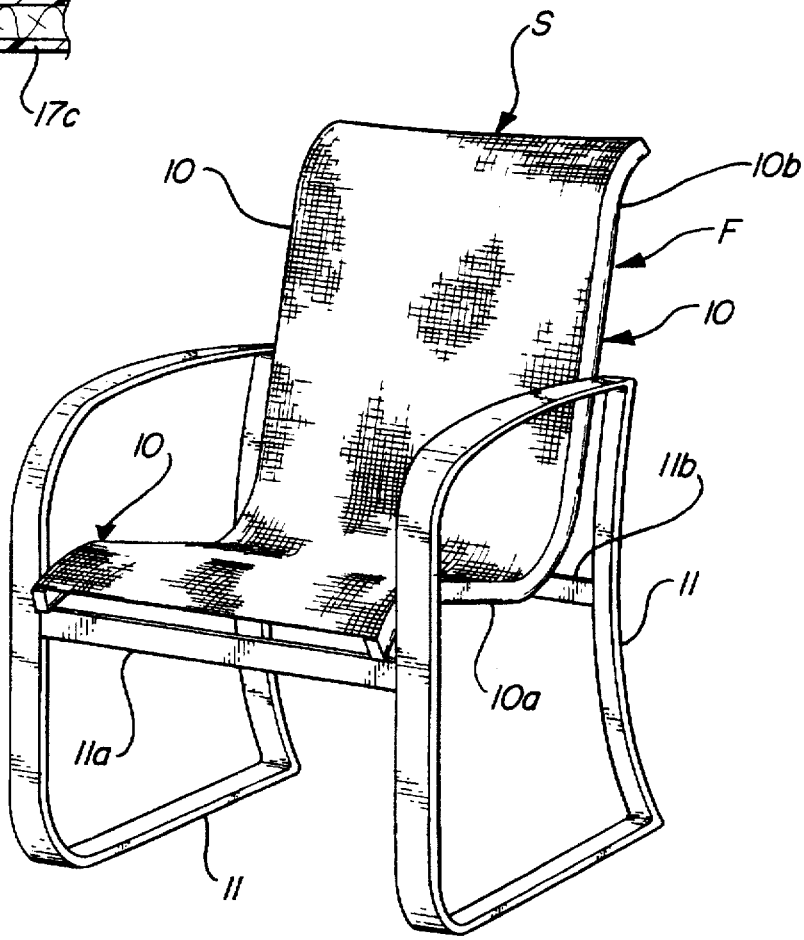
FIG. 5 is a fragmentary, front elevational, perspective view illustrating a typical chair construction which could employ the invention.

A furniture product is illustrated in the drawings as comprising a chair having a sling frame, generally designated F, comprising a pair of side rails, generally designated 10, which may be supported on legs or leg structures 11 of any suitable construction. For a disclosure of conventional leg shapes, attention is directed to FIG. 5 which shows the leg structures 11 connected by front and rear braces **11*a* and 11*b*. The pair of laterally or transversely spaced rails 10 which are configured to provide a seat portion 10*a* and a back portion 10*b*** are connected by a weight supporting fabric sling, generally designated S.

Figure 1:
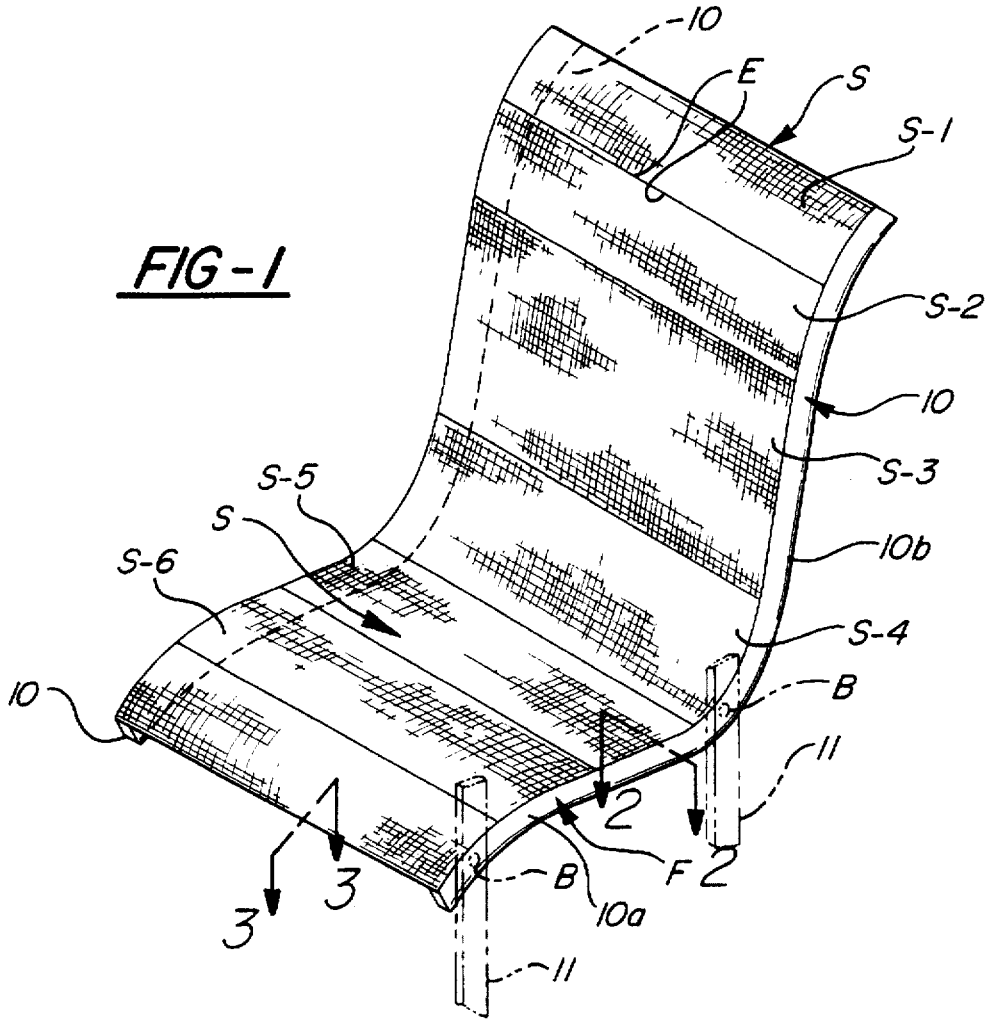
Figure 2:
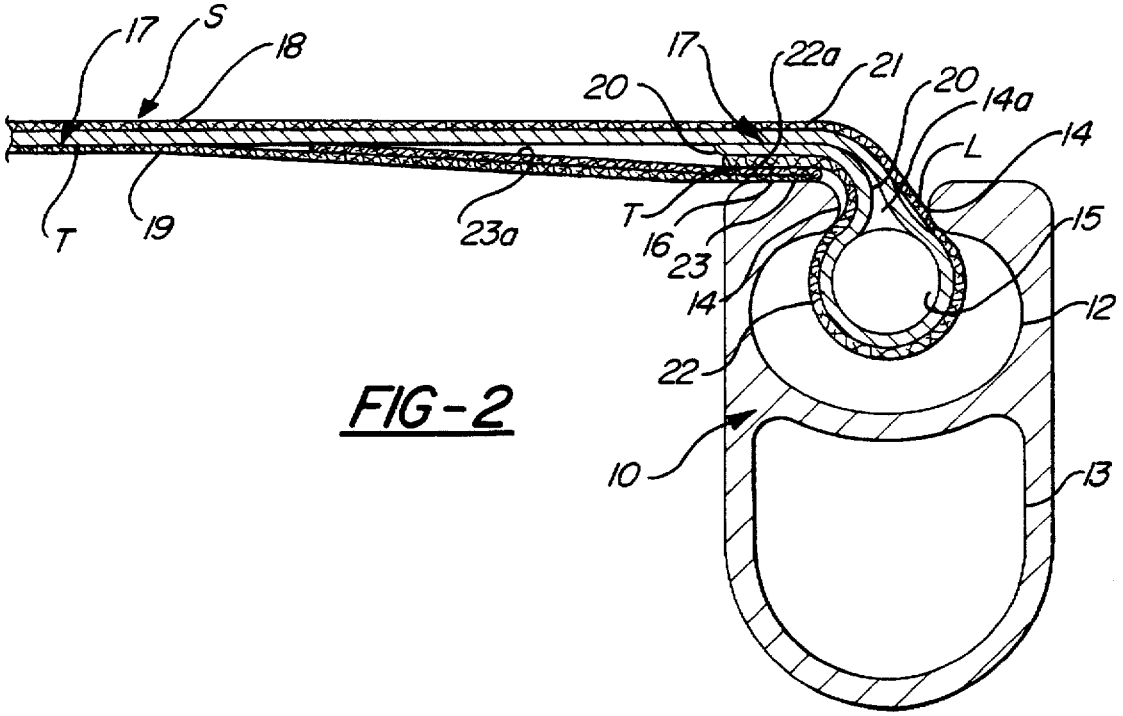

The rails 10 may comprise aluminum extrusions which are bent or formed to the configuration disclosed in FIG. 1, and it will be noted that these rails 10 are formed with longitudinally extending cavities 12 and 13 (FIG. 2). The cavity 13 simply lightens up the rail. However, the cavity 12, which has an open upper reduced neck portion 14, providing a gap **14*a*, has another more important function. It houses a longitudinally extending flexible and resilient plastic retaining rod or suitable 15 of greater diameter than the gap 14*a* provided by the neck portion 14 of opening 12. It will be observed that the inner upper faces of the side rails 10 are flat, as shown at 16, to provide a support seat for the composite slings which can receive a reinforced portion of the slings when the slings and rails 10 are in assembled condition as shown in FIG. 2**.

Figure 4:
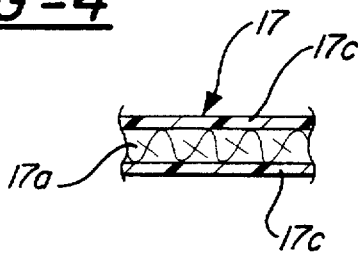
FIG. 4 is an enlarged cross-sectional view through the sling core sheet.

The composite sling S is constructed of a high strength core sheet, generally designated 17, which, as FIG. 4 discloses, comprises a central woven plastic fabric **17*a* consisting in the usual manner of fibers forming warp and weft strands which are woven to provide a tough fabric. Typically, the warp and weft strands are made of nylon yarn or strands and these are provided with a polyvinyl chloride coating on each face as at 17*b* and 17*c*. The fabric 17*a* also may be woven with polyester or other strands. Typically, the woven material 17*a* will be a thermosetting plastic fabric material and the coating material 17*b* and 17*c*** must be a thermoplastic material for a purpose which presently will become apparent.

While the coatings or coats **17*b* and 17*c* are disclosed as vinyl coats, it is thought that other polyolefins, such as polypropylene and polyethylene, or other thermoplastic coats, may also be workable from a structural point of view. The material 17 may be the material known as Textilene 21-9906B marketed by Twitchell Company of Dothan, Ala. Provided as an overcover for the material 17, is a sheet 18** of decorative fabric which may be acrylic in nature. It can, for example, be the highly polymerized acrylonitrile known as "orlon", for example, or can be woven of any other acrylic or other fiber which can be decoratively colored. Printed cotton and polyester fabrics may also prove useful as overcover materials.

The composite sling depicted also includes an undercover 19 of the same fabric as the overcover. Typically the thickness of the under and over covers, individually, will be about half of the thickness of the central material 17 which accordingly may be aptly referenced as a main load bearing sheet. For example, when the central or core material 17 is an ⅛" in thickness, the undercover and overcover will each be 1/16" in thickness. Because the furniture product may be used in an outdoor setting, which is exposed to rain, it is preferable to use undercover and overcover material which is of a synthetic plastic nature and is water impermeable. The overcover 18 and the undercover 19 may bear floral or other attractive patterns to provide a most attractive appearance.

As FIG. 2 indicates, the core material 17 at its end edges is formed with a loop portion generally designated L which is to receive the retaining rod 15. The loop L is formed by a free edge 20 which in assembled condition extends in through the gap 14*a*, around the rod 15, and out of the gap 14*a* to a position underlying the body of the core material 17, where it is heat fused to the body of the material 17 to form a double thickness seam 21. The overcover 18 similarly has a free edge cover loop 22 for core loop L which extends into the gap 14*a* around the retaining rod 15 and back to an edge portion 22*a* directly below the seam 21 in FIG. 2. Undercover 19 has a free edge portion 23 which extends in under the portions 21 and 22*a* to engage the seat surface 16, and then is folded back upon itself as shown at 23*a*. It is to be understood that the overcover portion 22*a* and the undercover portions 23 and 23*a* are stitched together as at T using a suitable thread, such as polyester thread. The weight of the seat occupant is essentially distributed along the rail surfaces 16 as shown and the free cut edges 20 and 23*a* of the overcover 18 and undercover 19, respectively, are in a protected position where they are not subject to ready unraveling.

Figure 3:
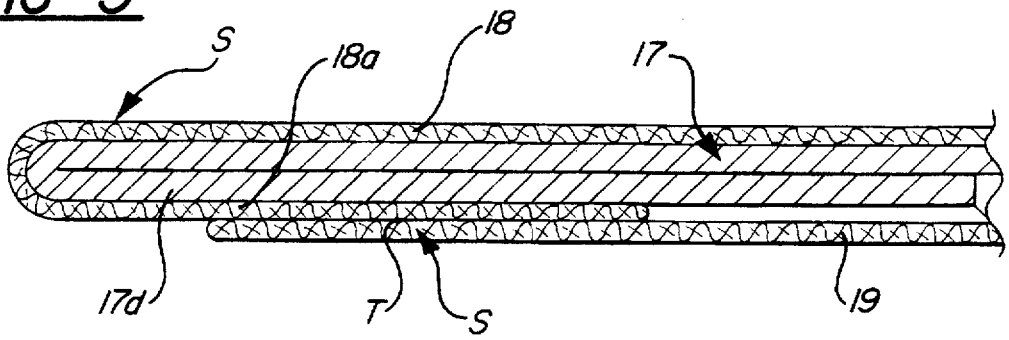
FIG. 3 is a greatly enlarged, fragmentary, schematic, sectional elevational view taken on the line 3—3 of FIG. 1.

FIG. 3 shows the manner in which the front and rear ends of the slings are constructed. It will be seen that the core material 17, at both ends, is turned back upon itself to form an underportion at 17*d*. The overcover extends around the core material 17 and then extends reversely as at 18*a* so that it can underlie the portion 17*d*. The end edges of undercover 19 again will be sewn with polyester thread, or other suitable thread, to the portions 18*a* at a location inset from the end edges of the sling construction and along the interface. The loops L and 22 form dual thickness composite closed loops. As FIG. 1 indicates, the slings are made up of panels S1 through S7 which are stitched together at their edges E after their assembly on the side rails 10.

In manufacturing the furniture product, the sling S is formed in fixtures in which the core material 17 is tautened in forming the loops L and then is heat welded or fused as at 20 in a taut condition in which wrinkles are removed. The overcover 18 is then stretched around the core material 17 and in a taut condition is stitched to the undercover 19. Again, the purpose of tautening the material is to remove the wrinkles.

The pre-fabricated sling end loops L of each of the panels S-1 through S-7 are then inserted into the cavities 12, and the resilient rods 15 are inserted into the cavities 12 through the open ends thereof through the loops L of the panel sections S1 through S7. This can be done before or after the side rails are bolted to the legs 11 of the chair as at B. Once the side rails are loosely bolted in position, with the loops L received in the cavities 12, the bolts B are tightened down in a manner to spread the rails 10 apart. This requires stretching of both the loops L and 20 to tauten them so that they stretch the sling surfaces of the panels S-1 through S-7. The flexible rods 15 extend from one end of the rails 10 to the other and assume the configuration of the rails 10 when inserted through the loops L.

It is when the sling and rail construction is assembled in the chair frame constituted by the connected legs 11 that the rails 10 are laterally pulled apart in the manner disclosed to tension and stretch the complete sling S and remove any wrinkles. Essentially in doing this, the sling S, in its entirety, is stretched about ½" to tauten the sling S and remove any bulges or wrinkles.

It is understood that other embodiments of the invention which accomplish the same function are incorporated herein within the scope of the following patent claims.

I claim:

1. In a furniture product incorporating a flexible composite sling with sling edge loops and a leg supported frame comprising transversely spaced apart tubular side rails having slotted openings in wall faces thereof for receiving the sling edge loops of said sling which spans said rails to support the weight of a furniture occupant, the side rails having retention members, of a cross-sectional configuration larger than said slotted openings extending through said loops, which retain said loops within said rails, the improvement wherein:

a) said sling includes a synthetic plastic core sheet, with sheet side edges, having over and under sides and formed of warp and weft fiber yarn fabric provided with synthetic thermoplastic coats on each side, the core sheet edges forming first closed loops and extending into said slotted openings and around said retention members, and then back out said slotted openings to positions forming seam folds of double core sheet thickness heat welded together and bearing upon and braced by said rails; and b) said composite sling incorporates a decorative overcover for said core sheet having overcover edges also extending into said slotted openings and around said retention members, and then back out said slotted openings to a position underlying said seam folds to form overcover loops for said first loops; and c) an undercover is provided for said core sheet, terminating in edge portions extending to underlie said seam folds and connecting with said into said slotted openings and around said retention members, and then back out said slotted openings to form overcover loops for said first loops.

2. The improvement of claim 1 wherein said undercover edge portions fold back to underlie said overcover and are sewn thereto.

3. The improvement of claim 2 wherein said overcover and undercover are formed of woven warp and weft fiber strands.

4. The improvement of claim 1 wherein said core sheet has front and rear ends and the core sheet is folded back under at its front and rear ends to form core sheet underportions heat welded to said core sheet to form double thickness end seams; said overcover extending beyond said sling ends and being folded back under to form undercover end underportions; and said undercover extends to said underportions of the overcover and is joined thereto.

5. In a furniture product incorporating a flexible composite sling with sling edge loops and a leg supported frame having transversely spaced apart tubular side rails with load bearing top walls having slotted openings for receiving the sling edge loops of said sling which spans said rails to at least partly support the weight load of a furniture occupant, the side rails having retention members, of a cross-sectional configuration larger than said slotted openings extending through said loops, which retain said loops within said rails, the improvement wherein:

a) said sling includes a synthetic main load bearing sheet, having over and under sides and formed of warp and weft fiber yarn fabric provided with synthetic thermoplastic coats on each side, the said sheet having sheet side edges forming first loops and extending into said slotted openings and around said retention members, and then back out said slotted openings to heat fuse to said sheet directly above said top walls and provide seam folds of fused double sheet thickness bearing upon and protected by load distributed along said top walls of said rails; and b) a decorative overcover secured to face the over side of said sheet, having loop forming edges extending into said slotted openings and around said retention members, and then back out said slotted openings and under said seam folds to form overcover loops for said first loops.

6. The product of claim 5 wherein an undercover, provided for said sheet, has edges extending to underlie said seam folds and overcover, and is sewn to said overcover.

7. The improvement of claim 6 wherein said undercover edges fold back to underlie said overcover beneath said seam folds.

8. The improvement of claim 6 wherein the main load bearing sheet has front and rear ends and the sheet is folded back under at its ends to form sheet underportions heat welded to said sheet to provide double thickness seams; said overcover extending beyond said sheet ends and being folded back under to form undercover end underportions; and said undercover extends to said underportions of the overcover and is secured thereto.

9. The improvement of claim 5 wherein said overcover is formed of woven warp and weft fiber strands.

10. A method of making a furniture product incorporating a composite flexible fabric sling with sling edge loops and a leg supported frame carrying transversely spaced apart tubular side rails, said rails having load bearing upward facing walls with slotted openings for receiving said sling edge loops of said sling which spans said rails to at least partly support the weight of a furniture occupant; the side rails having retention members, of a cross-sectional configuration larger than said slotted openings extending through said loops, which retain said loops within said rails; said sling including a synthetic main load bearing sheet, having over and under sides and formed of warp and weft fiber yarn fabric provided with synthetic thermoplastic coats on each side; the main load bearing sheet having edges extending into said slotted openings and around said retention members, and then back out said slotted openings to heat fuse to said sheet and provide seam folds of double sheet thickness; and a decorative fabric cover secured to face the overside of said main load bearing sheet having loop forming edges extending over said main load bearing sheet loops into said slotted openings and around said retention members, and then back out said slotted openings to extend under said sheet edges, the steps of:

a) positioning the main load bearing sheet edges to extend into said rail slotted openings, around said retention members and back out said openings to a position to form said seam folds and heat welding the seam folds of double main load bearing sheet thickness at a position such that they will lie upon said upward facing walls and be braced by load placed upon said upward facing walls of said side rails; and b) securing said cover around said main load bearing sheet.

11. The method of claim 10 wherein said cover is secured by providing an undercover for said main load bearing sheet and sewing it to said cover for the overside of said main load bearing sheet.

12. The method of claim 10 wherein said sling is made up of abutting panels and said side rails are spread when attached to said leg supported frame to stretch the main load bearing sheet and cover of each of said panels.

13. The method of claim 10 wherein the cover and main load bearing sheet have front and rear ends and the main load bearing sheet is folded back under at its end to form underportions, heat welding said underportions to said main load bearing sheet to form double thickness seams; and extending said cover beyond said main load bearing sheet ends and folding it back under to form cover end underportions; and securing said cover end underportions in position.

14. The method of claim 13 wherein said cover end underportions are secured in position by joining them to an undercover sheet positioned to underlie said main load bearing sheet underportions.

15. The method of claim 10 wherein an undercover has edges terminating at said rails and the step of securing said undercover edges to said overcover edges is performed to thereby envelop said main load bearing sheet.

16. In a furniture product incorporating a flexible composite sling with sling edge loops and a leg supported frame having transversely spaced apart tubular side rails having upward facing walls with slotted openings for receiving the sling edge loops of said sling which spans said rails to at least partly support the weight of a furniture occupant, the side rails having retention members, of a cross-sectional configuration larger than said slotted openings extending through said loops, which retain said loops within said rails, the improvement wherein:

a) said sling includes a synthetic main load bearing sheet, having over and under sides and formed of warp and weft fiber yarn fabric provided with synthetic thermoplastic coats on each side, the said sheet having sheet edges forming first loops and extending into said slotted openings and around said retention member, and then back out said slotted openings to heat fuse to said sheet directly above said upward facing walls and provide fused seam folds of double sheet thickness, said fused seam folds being positioned to bear on and be braced by load placed upon said upward facing walls of the rails; and b) a decorative overcover secured to cover said sheet.

17. The product of claim 16 wherein the upward facing walls have generally flat portions upon which said seams bear inboard of said slotted openings.

* * * * *

UNITED STATES PATENT AND TRADEMARK OFFICE

CERTIFICATE OF CORRECTION

PATENT NO. : 5,762,403
DATED : June 9, 1998
INVENTOR(S) : Steven D. Robinson

It is certified that error appears in the above-indentified patent and that said Letters Patent is hereby corrected as shown below:

Column 2, line 46, after "suitable" insert -- retention member --.

Column 4, rewrite lines 52-57 as follows:
(c) an undercover is provided for said core sheet, terminating in edge portions extending to underlie said seam folds and connecting with said overcover.

Signed and Sealed this
Seventeenth Day of November, 1998

*Attest:*

Bruce Lehman

BRUCE LEHMAN

*Attesting Officer*

*Commissioner of Patents and Trademarks*